US008353122B2

(12) United States Patent
Vielbig

(10) Patent No.: US 8,353,122 B2
(45) **Date of Patent: *Jan. 15, 2013**

(54) FIREARM EMITTING WHISTLE SOUND

(76) Inventor: Matthew R. Vielbig, Renton, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/284,789

(22) Filed: Oct. 28, 2011

(65) Prior Publication Data

US 2012/0042553 A1 Feb. 23, 2012

Related U.S. Application Data

(63) Continuation of application No. 12/422,393, filed on Apr. 13, 2009, now Pat. No. 8,096,073.

(60) Provisional application No. 61/044,676, filed on Apr. 14, 2008.

(51) Int. Cl.
*F41A 9/53* (2006.01)

(52) U.S. Cl. ..... 42/1.01; 42/90; 42/106; 89/14.4

(58) Field of Classification Search ..... 42/1.01, 42/90, 106; 89/191.01, 191.02, 192, 193, 89/198, 14.2, 14.3, 14.4
See application file for complete search history.

(56) References Cited

U.S. PATENT DOCUMENTS 3,669,059 A * 6/1972 Stuart ..... 116/67 R
4,223,804 A * 9/1980 Morris et al. ..... 222/3
4,266,357 A * 5/1981 Greenleaf ..... 42/1.15
4,449,474 A * 5/1984 Mariol ..... 116/2
4,599,817 A * 7/1986 Scheible ..... 42/1.15
5,183,951 A * 2/1993 Bilodeau ..... 42/1.01
5,302,938 A * 4/1994 Martineau ..... 340/573.2
5,529,215 A * 6/1996 Banks et al. ..... 222/113
6,890,178 B2 * 5/2005 Gouko et al. ..... 434/19
7,305,788 B1 * 12/2007 McLain ..... 42/1.08
8,096,073 B2 * 1/2012 Vielbig ..... 42/1.01
2004/0211103 A1 * 10/2004 Aske ..... 42/70.11
2007/0137085 A1 * 6/2007 Aske ..... 42/70.11

* cited by examiner

*Primary Examiner* — Michael David

(74) *Attorney, Agent, or Firm* — James J. Ruttler; Michael Gibbons

(57) ABSTRACT

A firearm having a barrel and a whistle, wherein when the firearm is discharged a bullet traveling down the barrel forces air through the whistle to cause a whistle sound. The whistle comprises a barrel port, a channel, and a whistle port and wherein when the firearm is discharged a bullet traveling down the barrel forces air through the barrel port, the channel, and the whistle port to cause a whistle sound. The whistle may be associated with a firearm attachment and the firearm attachment is removably couplable to the firearm. The whistle may also be modifiable and modification of the whistle is configurable to eliminate or change the whistle sound. The whistle sound may also be associated with a signal that is transmitted to another device or central location for analysis, wherein the signal comprises a firearm identification or locational information.

14 Claims, 8 Drawing Sheets

FIREARM EMITTING WHISTLE SOUND

PRIORITY CLAIM

This application is a continuation of U.S. patent application Ser. No. 12/422,393 filed Apr. 13, 2009 (our ref. VIEL-1-1001-1), and claims the benefit of U.S. provisional patent application Ser. No. 61/044,676 filed Apr. 14, 2008 (our ref. VIEL-1-1001). The foregoing applications are incorporated by reference in their entirety as if fully set forth herein.

FIELD OF THE INVENTION

This invention relates generally to firearms, and more specifically, to a firearms safety mechanism.

BACKGROUND

It is difficult to remotely identify a discharged firearm and distinguish that discharged firearm from other proximately discharged firearms. For example, when law enforcement officers are engaging one or more suspects, it is difficult for those law enforcement officers to distinguish between friendly and hostile fire. This is important because law enforcement officers must make safety decisions that depend upon the source of any discharged firearm. Unfortunately, without reliable information on the source of a discharged firearm, it is common for law enforcement officers to err on the side of caution and unnecessarily discharge firearms without fully understanding the situation. This phenomenon is known as "contagious gunfire", which describes the concept that when one person in a standoff discharges a firearm others will also discharge their firearms without understanding the source of the original shot. This result escalates conflict and increases the risks of injury, death, and property damage. Thus, the ability to identify a discharged firearm and distinguish that discharged firearm from other proximately discharged firearms would reduce or eliminate the chance of contagious gunfire occurring.

Accordingly, while desirable results have been achieved, there exists much room for improvement. What is needed then is a firearms safety mechanism to identify a discharged firearm.

SUMMARY

This invention relates generally to firearms, and more specifically, to a firearms safety mechanism. In some embodiments, a firearms safety mechanism includes a system for providing a firearm that emits a distinguishable audible sound. In one embodiment, the invention includes a firearm having a barrel and a whistle, wherein when the firearm is discharged air is forced through the whistle to cause a whistle sound. In one particular embodiment, the whistle comprises a barrel port, a channel, and a whistle port and wherein when the firearm is discharged a bullet traveling down the barrel forces air through the barrel port, the channel, and the whistle port to cause a whistle sound. In another embodiment, the whistle is associated with a firearm attachment and the firearm attachment is removably couplable to the firearm. In a further embodiment, the whistle is modifiable and modification of the whistle is configurable to eliminate or change the whistle sound. In a further embodiment, the whistle sound is associated with a signal that is transmitted to another device or central location for analysis, wherein the signal comprises a firearm identification or locational information.

BRIEF DESCRIPTION OF THE DRAWINGS

Embodiments of the present invention are described in detail below with reference to the following drawings.

DETAILED DESCRIPTION

Figure 1:
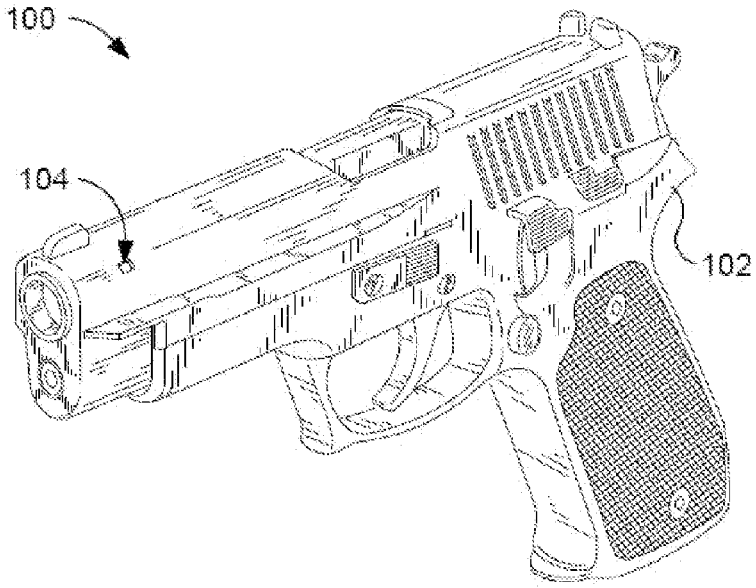
FIG. 1 is a perspective view of a firearm having an incorporated whistle port, in accordance with an embodiment of the invention.
Figure 2:
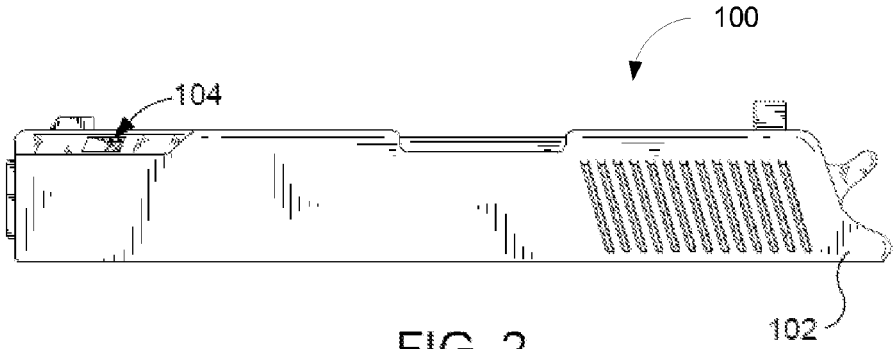
FIG. 2 is a partial side elevational view of a firearm having an incorporated whistle port, in accordance with an embodiment of the invention.
Figure 3:
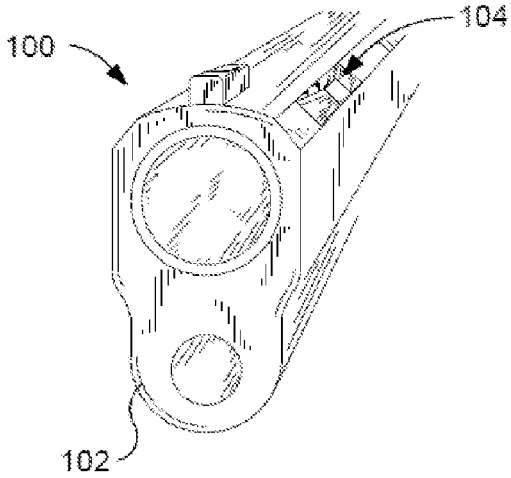
FIG. 3 is a partial perspective view of a firearm having an incorporated whistle port, in accordance with an embodiment of the invention.
Figure 4:
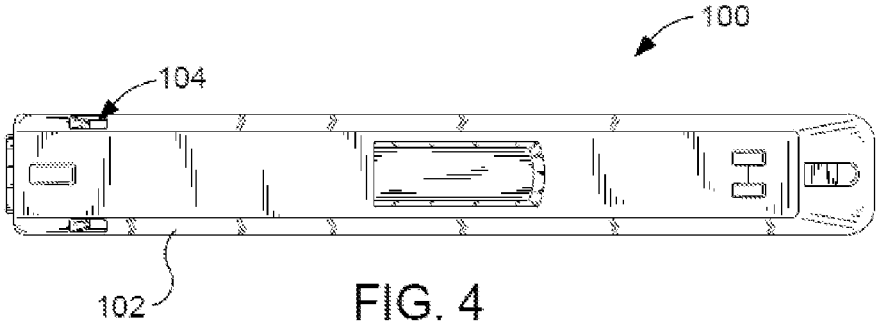
FIG. 4 is a top plan view of a firearm having an incorporated whistle port, in accordance with an embodiment of the invention.

This invention relates generally to firearms, and more specifically, to a firearms safety mechanism. Specific details of certain embodiments of the invention are set forth in the following description and in FIGS. 1-13 to provide a thorough understanding of such embodiments. The present invention may have additional embodiments, may be practiced without one or more of the details described for any particular described embodiment, or may have any detail described for one particular embodiment practiced with any other detail described for another embodiment.

FIGS. 1-4 are various views of a firearm having an incorporated whistle port, in accordance with an embodiment of the invention. In some embodiments, a firearms safety mechanism includes a system for providing a firearm that emits a distinguishable audible sound. In one embodiment, system 100 includes a firearm 102, a whistle port 104, and a barrel 302 (barrel 302 being shown in FIG. 5, inter alia). When the firearm 102 is discharged, a bullet (not illustrated) traveling down the barrel 302 forces air through the whistle port 104, thereby emitting a whistle sound that is distinguishable from a typical sound of a discharged firearm.

In certain embodiments, the system 100 includes a plurality of whistle ports 104 to produce louder, harmonic, or multiple distinguishable audible sounds in series or parallel. In another embodiment, the whistle port 104 is alternatively shaped or sized, such as circular, oval, square, or some other uniform or non-uniform shape. In a further embodiment, the whistle port 104 is alternatively disposed relative to the firearm 102, such as on a top, side, bottom, front, back, or corner; at a different angle; at a different position along a length; or on an attachment. In an additional embodiment, the whistle port 104 is embedded within the firearm 102, embedded on an exposed structure from the firearm 102, or otherwise associated with the firearm 102. In a different embodiment, the whistle port 104 size, shape, or disposition or the number of whistle ports 104 are modifiable, changeable, adjustable, interchangeable or otherwise alterable.

Figure 5:
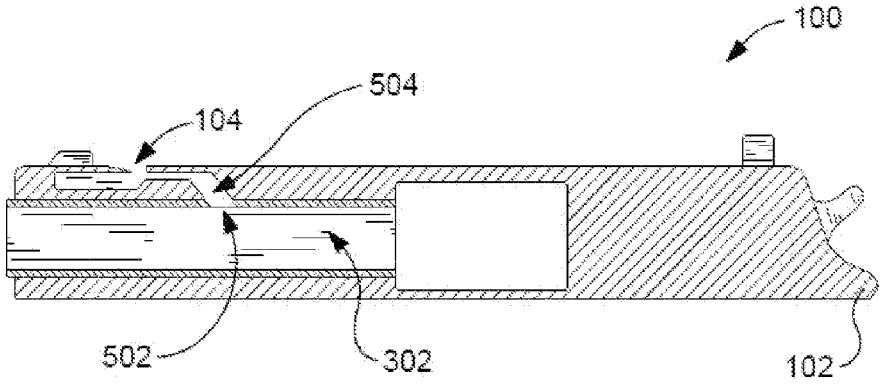
FIG. 5 is a partial side cross-sectional view of a firearm having an incorporated whistle port, in accordance with an embodiment of the invention.

FIG. 5 is a partial side cross-sectional view of a firearm having an incorporated whistle port, in accordance with an embodiment of the invention. In one embodiment, system 100 includes the firearm 102, the whistle port 104, the barrel 302, a barrel port 502, and a channel 504. The barrel port 502 is an orifice that extends the barrel 302 cavity through the channel 504. Accordingly, when the firearm 102 is discharged, a bullet (not illustrated) traveling down the barrel 302 forces air through the barrel port 502. The air then travels within the channel 504 and at least a portion of the air is forced through the whistle port 104, thereby emitting a whistle sound that is distinguishable from a typical sound of a discharged firearm.

Figure 6:
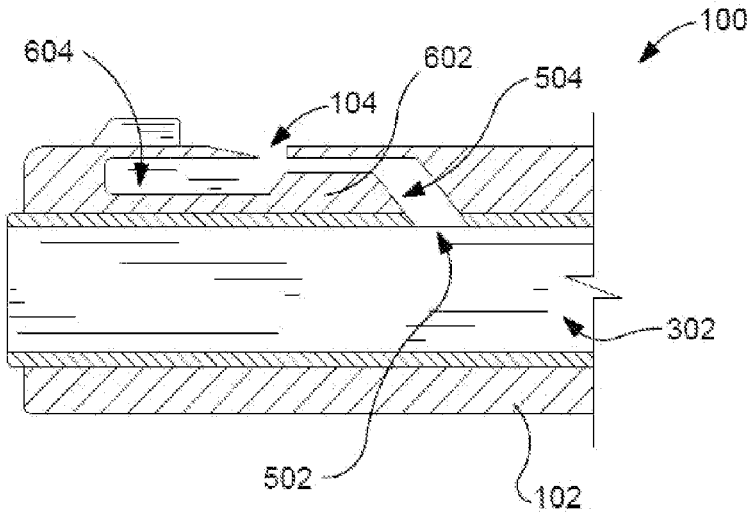
FIG. 6 is an enlarged partial side cross-sectional view of a firearm having an incorporated whistle port, in accordance with an embodiment of the invention.

FIG. 6 is an enlarged partial side cross-sectional view of a firearm having an incorporated whistle port, in accordance with an embodiment of the invention. In one embodiment, system 100 includes the firearm 102, the whistle port 104, the barrel 302, the barrel port 502, the channel 504, a channel block 602, and a chamber 604. The barrel port 502 is an orifice that provides an angled extension of the barrel 302 cavity with the channel 504. The channel 504 is partially constricted by the channel block 602 at a position approximately between the barrel port 502 and the whistle port 104. The chamber 604 provides a cavity continuous with the channel 504 at a position approximately beyond the whistle port 104. Accordingly, when the firearm 102 is discharged, a bullet (not illustrated) traveling down the barrel 302 forces air through the barrel port 502. The air then travels within the channel 504 where it is compressed at the channel block 602. At least a portion of the air collects within the chamber 604 and at least a portion of the air is forced through the whistle port 104, thereby emitting a whistle sound that is distinguishable from a typical sound of a discharged firearm.

In various embodiments, any of the barrel port 502, the channel 504, the channel block 602, the chamber 604, or the whistle port 104 has a different angle, shape, volume, course, or other similar characteristic or is omitted or supplemented by another structure. In a further embodiment, structure is provided to provide a whistle sound that is distinguishable from a typical sound of a discharged firearm through intersection of air flow, splitting air flow, and/or some other similar methodology. In certain embodiments, the aforementioned angle, shape, volume, course, or other similar characteristic is modifiable, changeable, adjustable, interchangeable or otherwise alterable. In an additional embodiment, a plurality of any of the barrel port 502, the channel 504, the channel block 602, the chamber 604, or the whistle port 104 are provided. In yet a further embodiment, air for emitting a whistle sound is obtained from a source alternative to the barrel 302, such as external to the firearm 102 or from an air supply device.

Figure 7:
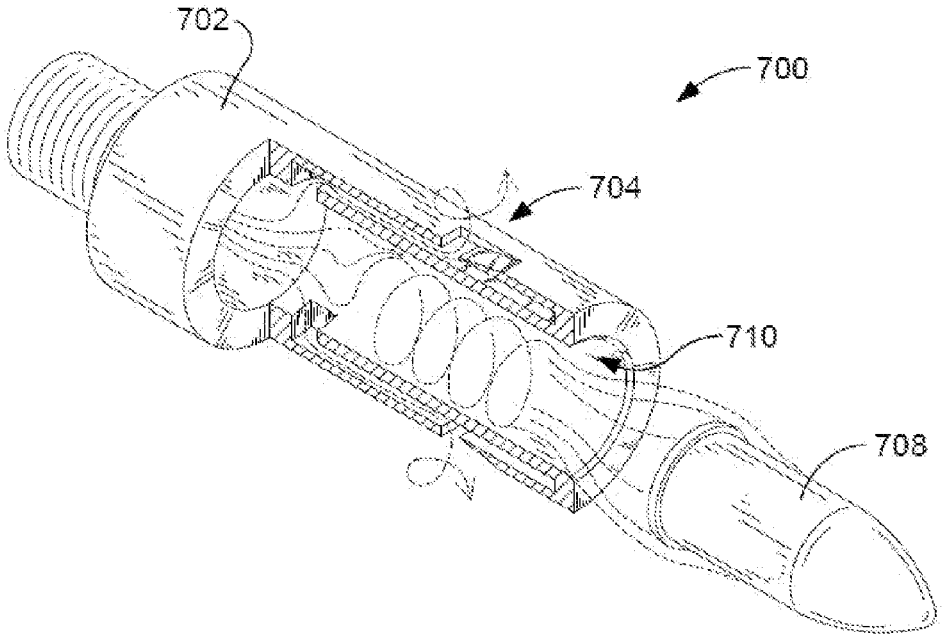
FIG. 7 is a perspective view of a firearm attachment having an incorporated whistle port, in accordance with an embodiment of the invention.

FIG. 7 is a perspective view of a firearm attachment having an incorporated whistle port, in accordance with an embodiment of the invention. In one embodiment, system 700 includes a firearm attachment 702, a whistle port 704, a bullet 708, and a barrel 710. The firearm attachment 702 is removably couplable to a firearm to extend the barrel of the firearm (not illustrated) with the barrel 710. When the firearm is discharged, the bullet 708 traveling down the barrel of the firearm and the barrel 710 forces air through the whistle port 704, thereby emitting a whistle sound that is distinguishable from a typical sound of a discharged firearm. Thus, when the firearm attachment 702 is coupled to the firearm a distinguishable sound is emitted upon discharge of the firearm.

In another embodiment, the firearm attachment 702 is differently attachable to the firearm, such as using a different fastening mechanism or through different placement relative to the firearm. In certain embodiments, the firearm attachment 702 includes structure to modify, change, adjust, or alter the distinguishable sound emitted upon discharge of the firearm. In another embodiment, the firearm attachment 702 is interchangeable with other firearm attachments 702 that provide for different distinguishable sounds. These other firearm attachments 702 are further combinable within a kit. In a different embodiment, a system for providing an electronic or wireless synchronization signal is provided such that a plurality of firearm users can be synchronously notified as to which distinguishable sound should be emitted for identification purposes. The notification is providable visually or audibly, such as through a display or through verbal instruction. In a related embodiment, a system for providing notification when the distinguishable sound emitted is inconsistent with the desired distinguishable sound is provided.

Figure 8:
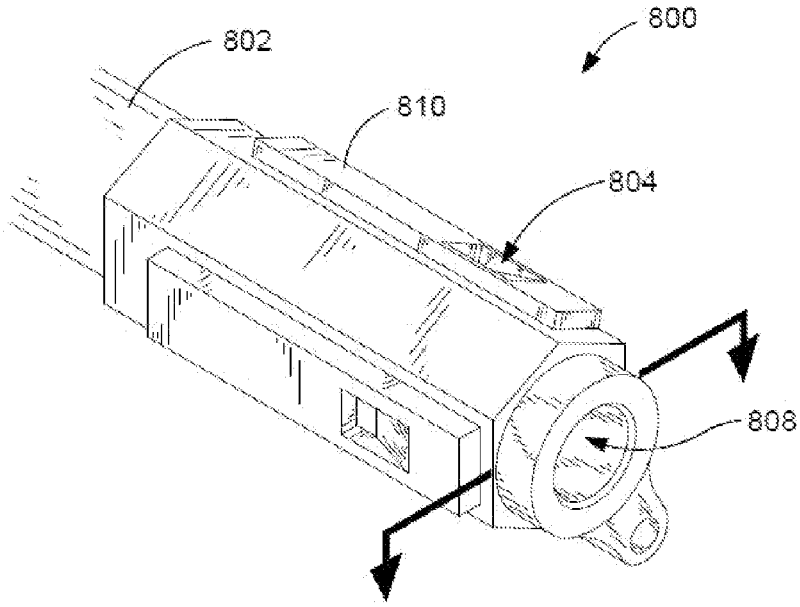
FIG. 8 is a perspective view of a firearm having an incorporated whistle port, in accordance with an embodiment of the invention.

FIG. 8 is a perspective view of a firearm having an incorporated whistle port, in accordance with an embodiment of the invention. In one embodiment, system 800 includes a firearm 802, a whistle port 804, and a barrel 808. The whistle port 804 is embodied within an exposed housing 810. When the firearm 802 is discharged, a bullet (not illustrated) traveling down the barrel 808 forces air through the whistle port 804, thereby emitting a whistle sound that is distinguishable from a typical sound of a discharged firearm.

Figure 9:
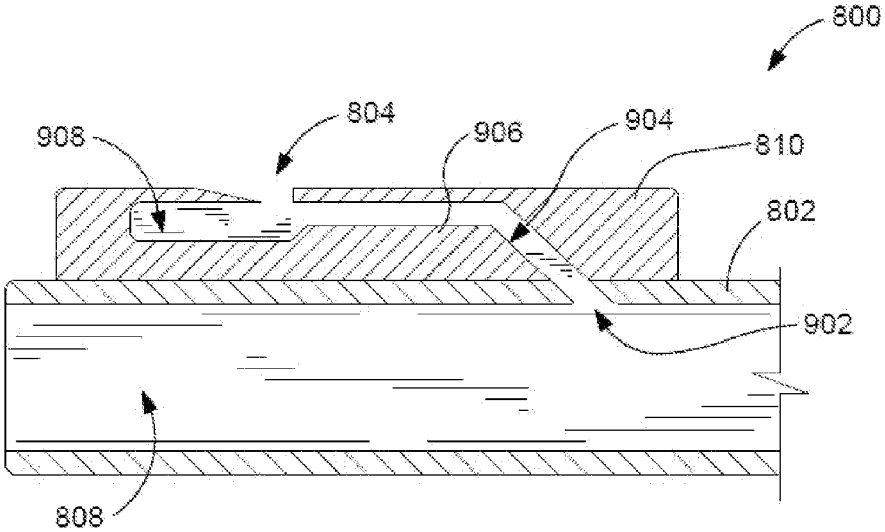
FIG. 9 is an enlarged partial side cross-sectional view of a firearm having an incorporated whistle port, in accordance with an embodiment of the invention.

FIG. 9 is an enlarged partial side cross-sectional view of a firearm having an incorporated whistle port, in accordance with an embodiment of the invention. In one embodiment, system 800 includes the firearm 802, the whistle port 804, the barrel 808, a barrel port 902, a channel 904, a channel block 906, and a chamber 908. The channel 904, the channel block 906, the chamber 908, and the whistle port 804 are embodied within the exposed housing 810. The barrel port 902 is an orifice that provides an angled extension of the barrel 808 cavity with the channel 904. The channel 904 is constricted by the channel block 906 at a position approximately between the barrel port 902 and the whistle port 804. The chamber 908 provides a cavity continuous with the channel 904 at a position approximately beyond the whistle port 804. Accordingly, when the firearm 802 is discharged, a bullet (not illustrated) traveling down the barrel 808 forces air through the barrel port 902. The air then travels within the channel 904 where it is compressed at the channel block 906. At least a portion of the air collects within the chamber 908 and at least a portion of the air is forced through the whistle port 804, thereby emitting a whistle sound that is distinguishable from a typical sound of a discharged firearm.

In certain embodiments, the exposed housing 810 is removable, adjustable, or interchangeable whereas in other embodiments the exposed housing 810 is fixedly disposed relative to the firearm 802. In other embodiments, the exposed housing 810 is only partially exposed. In another embodiment, the whistle port 804 is disposed directly within the barrel 810 or attachment of the firearm 802. In a further embodiment, the whistle port 804 is associated with a chamber of a gas carbine-type rifle.

Figure 10:
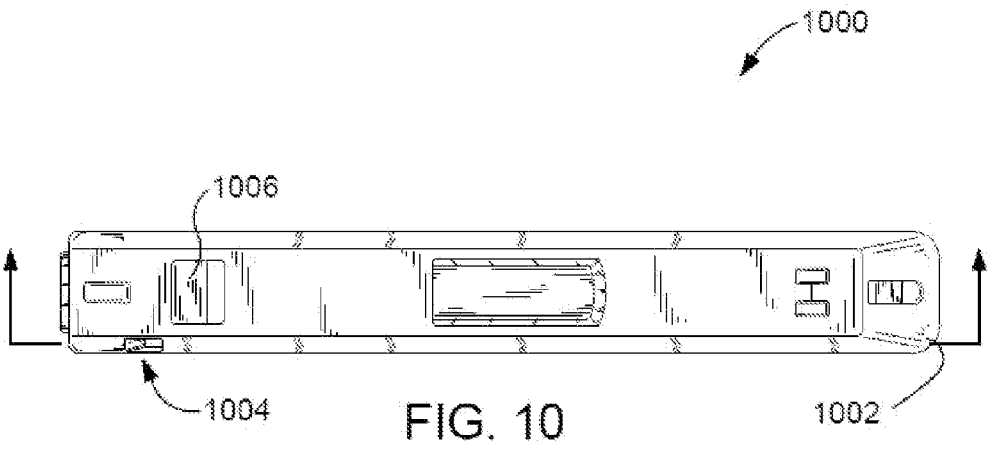
FIG. 10 is a top plan view of a firearm having a modifiable whistle port, in accordance with an embodiment of the invention.

FIG. 10 is a top plan view of a firearm having a modifiable whistle port, in accordance with an embodiment of the invention. In one embodiment, system 1000 includes a firearm 1002, a whistle port 1004, and a switch 1006. The switch 1006 is movable between at least two positions to close or modify the shape of the whistle port 1004. When the firearm 1002 is discharged, a bullet (not illustrated) traveling down the barrel (not visible) forces air through the whistle port 1004, thereby emitting a whistle sound that is distinguishable from a typical sound of a discharged firearm. The switch 1006 is adjustable to eliminate or change the whistle sound.

In certain embodiments, the switch 1006 is mechanical, electro-mechanical, or electronic. In another embodiment, the switch 1006 is activated through physical contact, audible instruction, or through an electronic signal. In a further embodiment, the switch 1006 can control a plurality of whistle sound settings relating to attributes, such as volume, pitch, and duration. In an additional embodiment, the switch 1006 can control a plurality of whistle ports 1004. In one particular embodiment, the switch 1006 includes biometric security features to prevent unauthorized alteration of the whistle port 1004. In further embodiments, the switch 1006 is controllable wirelessly from a remote location or the switch 1006 is disposed at a remote location and operable to wirelessly adjust the whistle port 1004. In a different embodiment, the switch 1006 is usable to wirelessly and synchronously adjust one or more other whistle ports on remote firearms.

Figure 11:
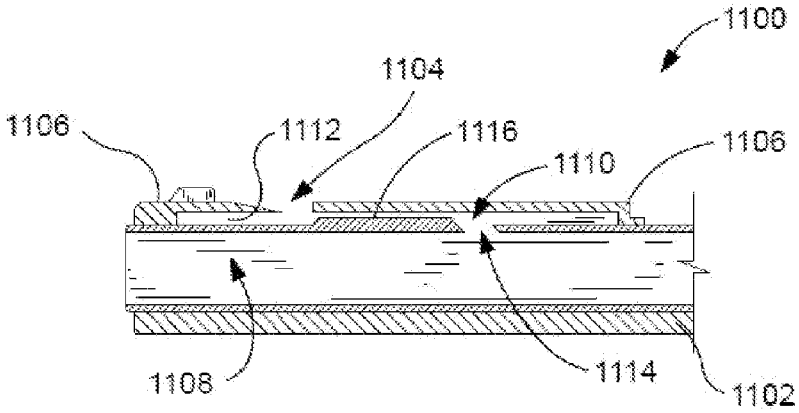
FIG. 11 is an enlarged partial side cross-sectional view of a firearm having a modifiable whistle port, in accordance with an embodiment of the invention.

FIG. 11 is an enlarged partial side cross-sectional view of a firearm having a modifiable whistle port, in accordance with an embodiment of the invention. In one embodiment, system 1100 includes a firearm 1102, a whistle port 1104, a movable housing 1106, a barrel 1108, a channel 1110, a barrel port 1114, a chamber 1112, and a channel block 1116. The movable housing 1106 is adjustable, removable, or replaceable relative to the firearm 1102 in whole or in part to close, modify, or replace the shape of the barrel port 1114, the channel 1110, the channel block 1116, the whistle port 1104, or the chamber 1112. Accordingly, when the firearm 1102 is discharged, a bullet (not illustrated) traveling down the barrel 1108 forces air through the barrel port 1114. The air then travels within the channel 1110 where it is compressed at the channel block 1116. At least a portion of the air collects within the chamber 1112, which contributes to at least a portion of the air also being forced through the whistle port 1104, thereby emitting a whistle sound that is distinguishable from a typical sound of a discharged firearm. The movable housing 1106 is adjustable, removable, or replaceable to eliminate or change the whistle sound.

In certain embodiments, the movable housing 1106 includes one or more of the structures defined by the barrel port 1114, the channel 1110, the channel block 1116, the chamber 1112, and the whistle port 1104. In another embodiment, the movable housing 1106 is coupled to the firearm 1102 through slidable receiving rails, a latch, a fastener, or some other similar mechanism. In a further embodiment, the movable housing 1106 is adjustable by length, width, height, volume or by the size, shape, angle, number, or course of the barrel port 1114, the channel 1110, the channel block 1116, the chamber 1112, or the whistle port 1104.

Figure 12:
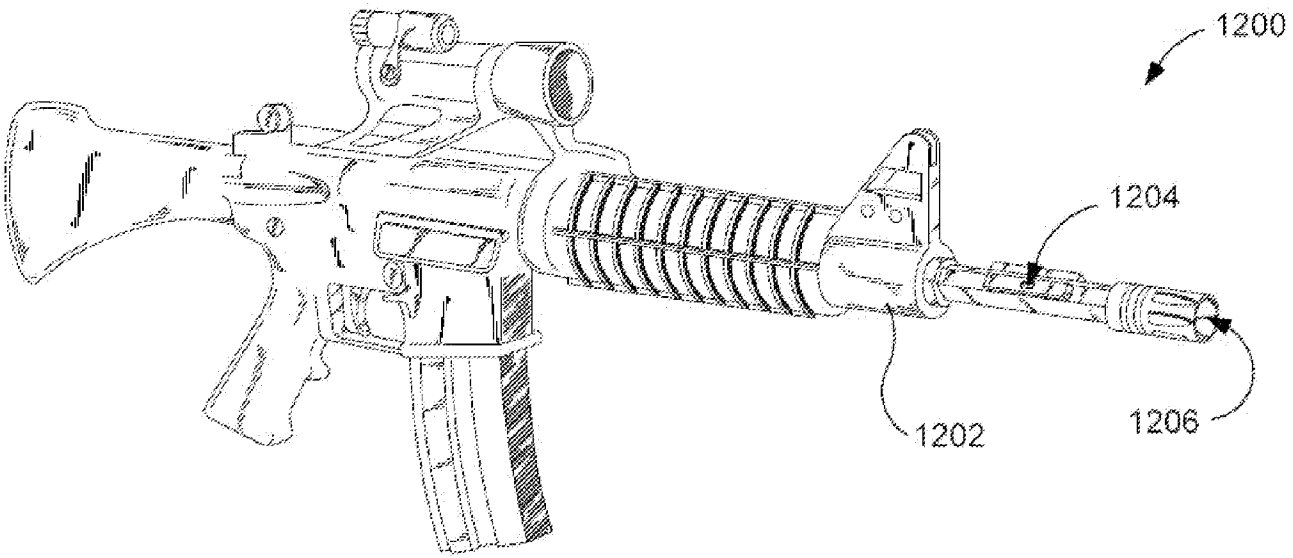
FIG. 12 is a perspective view of a firearm having an incorporated whistle port, in accordance with an embodiment of the invention.
Figure 13:
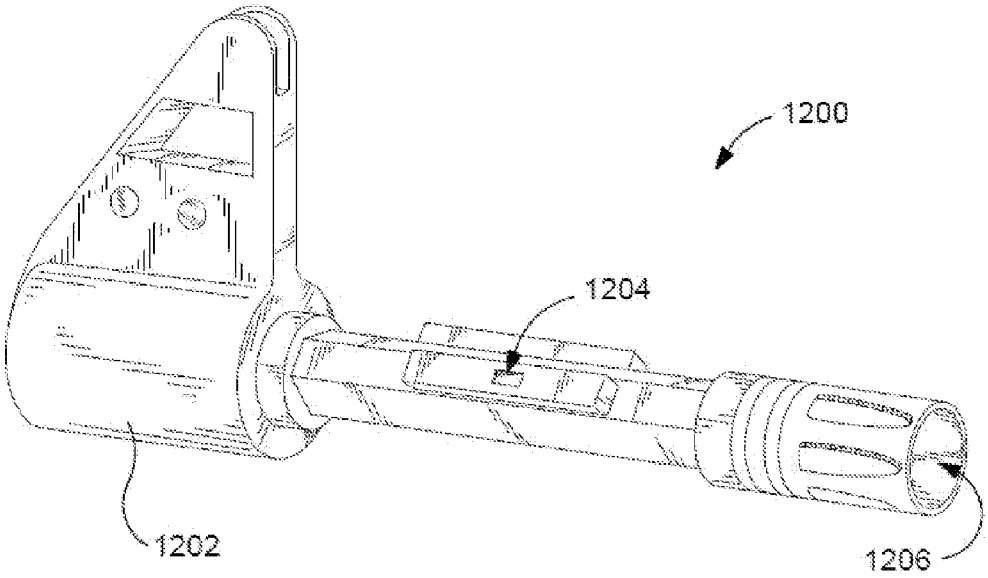
FIG. 13 is an enlarged partial perspective view of a firearm having an incorporated whistle port, in accordance with an embodiment of the invention.

FIGS. 12 and 13 are various views of a firearm having an incorporated whistle port, in accordance with an embodiment of the invention. In one embodiment, system 1200 includes a firearm 1202, a whistle port 1204, and a barrel 1206. When the firearm 1202 is discharged, a bullet (not illustrated) traveling down the barrel 1206 forces air through the whistle port 1204, thereby emitting a whistle sound that is distinguishable from a typical sound of a discharged firearm. The firearm 1202 can be any manual, automatic, or semi-automatic gun including a revolver, machine gun, rifle, or shotgun.

In other embodiments, the whistle sound is produced from the sucking of air as opposed to the pushing of air. In a further embodiment, the distinguishable audible sound is amplifiable. In another embodiment, the distinguishable audible sound is a beep, tone, siren, or any other sound, that is manually or electronically triggered by discharge of a firearm. In yet a further embodiment, the distinguishable audible sound is not audible and is only perceptible with the use of another device. In another embodiment, the distinguishable audible sound is supplemented or replaced by distinguishable visual cues. In certain embodiments, the distinguishable audible sound or the distinguishable visual cue is embodied within a signal that is transmitted to one or more devices wirelessly, which produces the sound or visual cue based on the signal. In a related embodiment, discharge of a firearm results in transmission of a digital or analog signal to another device or central command center for analysis. Such signal can include firearm identification and locational information through GPS. Accordingly, another device or a central command center is able to remotely monitor the identity and location one or more discharged firearms.

In a further embodiment, a device is provided that is configurable to receive the distinguishable audible sound and determine whether it is consistent with an expected sound. For example, an individual can wear the device to confirm whether a distinguishable audible sound is originating from a friendly distant firearm. The device provides a display or audible instructions such as "friendly fire" or "hostile fire" in response to the distinguishable audible sound.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A firearm comprising:

a barrel;

a whistle; and a barrel port, the barrel port disposed between the barrel and the whistle, wherein the barrel port is not a muzzle of the firearm, wherein when the firearm is discharged a bullet traveling down the barrel forces air through the whistle to cause a whistle sound.

2. The firearm of claim 1, wherein the whistle comprises a channel and a whistle port and wherein when the firearm is discharged a bullet traveling down the barrel forces air through the barrel port, the channel, and the whistle port to cause a whistle sound.

3. The firearm of claim 2, wherein the whistle further comprises a channel block, wherein the channel block partially constricts the channel at a position approximately between the barrel port and the whistle port, and wherein when air traveling within the channel is compressed at the channel block.

4. The firearm of claim 3, wherein the whistle further comprises a chamber, wherein the chamber is a cavity continuous with the channel at a position approximately beyond the whistle port, and wherein at least a portion of air traveling from the channel collects within the chamber and at least a portion of air traveling from the channel is forced through the whistle port.

5. The firearm of claim 1, wherein the barrel port comprises an orifice disposed through the side of the barrel.

6. The firearm of claim 1, wherein the whistle is associated with a firearm attachment and wherein the firearm attachment is removably couplable to the firearm.

7. The firearm of claim 1, wherein the whistle is associated with a movable housing and wherein the movable housing is adjustable or removable and wherein adjustment or removal of the movable housing is configurable to eliminate or change the whistle sound.

8. The firearm of claim 1, wherein the whistle is modifiable and wherein modification of the whistle is configurable to eliminate or change the whistle sound.

9. The firearm of claim 8, wherein the whistle is modifiable physically, electronically, or electro-mechanically.

10. The firearm of claim 8, wherein the whistle is remotely modifiable.

11. The firearm of claim 8, wherein modification of the whistle is configured to synchronously modify at least one other whistle on at least one other remote firearm.

12. The firearm of claim 8, wherein the whistle is modifiable in accordance with security features.

13. The firearm of claim 1, wherein the whistle sound is associated with a signal that is transmitted to another device or central location for analysis.

14. The firearm of claim 13, wherein the signal comprises a firearm identification or locational information.

* * * * *